US012104315B2

(12) United States Patent
Cartabbia

(10) Patent No.: US 12,104,315 B2
(45) Date of Patent: Oct. 1, 2024

(54) DEVICE FOR THE AUTOMATIC LOADING OF HANGERS IN AN APPARATUS FOR IRONING SHIRTS OR SIMILAR ITEMS AND APPARATUS COMPRISING SUCH DEVICE

(71) Applicant: MACPI S.P.A. PRESSING DIVISION, Palazzolo Sull'oglio (IT)

(72) Inventor: Paolo Cartabbia, Palazzolo Sull'oglio (IT)

(73) Assignee: MACPI S.P.A. PRESSING DIVISION, Palazzolo Sull'Oglio (IT)

( * ) Notice: Subject to any disclaimer, the term of this patent is extended or adjusted under 35 U.S.C. 154(b) by 315 days.

(21) Appl. No.: 17/779,446

(22) PCT Filed: Feb. 23, 2021

(86) PCT No.: PCT/IB2021/051506
§ 371 (c)(1),
(2) Date: May 24, 2022

(87) PCT Pub. No.: WO2021/181185
PCT Pub. Date: Sep. 16, 2021

(65) Prior Publication Data

US 2023/0002958 A1 Jan. 5, 2023

(30) Foreign Application Priority Data

Mar. 10, 2020 (IT) ..... 102020000005056

(51) Int. Cl.
*D06F 95/00* (2006.01)
*A41H 43/02* (2006.01)
*D06F 93/00* (2006.01)

(52) U.S. Cl.
CPC ..... *D06F 95/00* (2013.01); *A41H 43/02* (2013.01); *D06F 93/005* (2013.01)

(58) Field of Classification Search
CPC ..... D06F 95/00; D06F 93/005; D06F 93/00; A41H 43/02; A41H 43/0207; A41H 43/0235; A41H 43/0242
See application file for complete search history.

(56) References Cited

U.S. PATENT DOCUMENTS 3,174,662 A * 3/1965 Kannegiesser ..... D06F 71/10 223/57
3,620,354 A * 11/1971 McMillan ..... D06F 71/38 198/465.4

(Continued)

FOREIGN PATENT DOCUMENTS

DE 2722067 A1 1/1979
EP 0209017 A1 1/1987
EP 2130789 A1 * 12/2009 ..... B65G 1/0457

OTHER PUBLICATIONS

Search Report dated May 31, 2021 in corresponding International Application No. PCT/IB2021/051506, 3 pages.

(Continued)

*Primary Examiner* — Ismael Izaguirre
(74) *Attorney, Agent, or Firm* — MH2 TECNOLOGY LAW GROUP LLP

(57) ABSTRACT

A device for the automatic loading of hangers in an apparatus for ironing shirts or similar items includes a storage configured to support a plurality of hangers and an arm comprising a gripping and releasing. The arm is movable between a first position and a second position. In the first position, the gripping and releasing end is close to the storage to pick up or receive a hanger from the storage, and in the second position, the gripping and releasing end is placed above the manikin placed upstream of a loading station of the apparatus, to release the hanger, previously picked up, into the seat of the manikin.

19 Claims, 8 Drawing Sheets

(56) References Cited

U.S. PATENT DOCUMENTS

| | | | | | |
|---|---|---|---|---|---|
| 3,684,130 | A | * | 8/1972 | Winslow | G07F 17/20 221/212 |
| 3,917,112 | A | * | 11/1975 | Willis | D06F 95/00 221/195 |
| 5,005,691 | A | * | 4/1991 | Jennewein | B65G 47/61 198/465.4 |
| 5,046,844 | A | * | 9/1991 | Milton | B65G 47/61 356/238.1 |
| 5,154,275 | A | * | 10/1992 | Speckhart | B65G 33/02 198/465.4 |
| 5,964,354 | A | | 10/1999 | Skinner | |

OTHER PUBLICATIONS

Written Opinion dated May 31, 2021 in corresponding International Application No. PCT/IB2021/051506, 6 pages.

* cited by examiner

DEVICE FOR THE AUTOMATIC LOADING OF HANGERS IN AN APPARATUS FOR IRONING SHIRTS OR SIMILAR ITEMS AND APPARATUS COMPRISING SUCH DEVICE

CROSS-REFERENCE TO RELATED APPLICATIONS

This is a U.S. National Stage of International Application No. PCT/IB2021/051506 filed Feb. 23, 2021, pending, which claims priority to Italian Patent Application No. 102020000005056 filed Mar. 10, 2020, the entire disclosures of which are hereby incorporated by reference in their entireties.

FIELD OF THE FINDING

The object of the present invention is a device for the automatic loading of hangers in an apparatus for ironing shirts or similar items and an apparatus provided with such device. The present invention is situated in the field of professional semi-automatic apparatuses for ironing shirts or similar items, used for example at laundries.

BACKGROUND OF THE FINDING

In such context, apparatuses are known for ironing shirts in series which comprise a plurality of operating stations and a carousel on which manikins are mounted. The carousel moves the manikins so as to arrange them one at a time in each operating station. Such operating stations comprise: a loading station, in which an operator positions a hanger and a shirt on the manikin, one or more ironing stations, in which the shirt arranged on the manikin is ironed by means of hot air and/or steam, an unloading station, in which a suitable device automatically picks up, from the manikin, the hanger and the shirt arranged thereon and conveys it into a storage.

The known document EP 0 209 017 illustrates a device which automatically loads hangers on manikins in a plant for ironing clothing articles. The manikins are carried on a conveyor between a hanger reception station, a station for mounting clothing articles on the hangers, a treatment station and a station for removing the hangers with the clothing articles. In the hanger reception station, the hangers, hung from a tilted bar of a storage, are deposited one at a time on respective manikins by means of a movable pin.

The Applicant has observed that the apparatuses of known type, like that described above, can be improved regarding various aspects with particular reference to the automation of the various operations.

In particular, the Applicant has observed that in the apparatuses of known type, the operator must complete a first manual operation, in order to load a hanger in a suitable seat of the manikin, and then complete a second manual operation, in order to arrange a shirt on the same manikin, in a manner such that the shirt is supported by the manikin and a hook or ring of the hanger protrudes from the neck of the shirt. The operator must also complete further operations in order to correctly arrange the shirt such that it is ironed in the correct manner in the subsequent station.

The Applicant has observed that the multiple manual operations must be executed by the operator with a certain speed compatible with the times of the apparatus.

This can compromise the precision with which the shirts are arranged on the apparatus and lead to an incorrect ironing and/or lead to a decrease of the speed of the machine and an increase of the cycle time necessary for ironing a shirt. In addition, the operator may over time become stressed.

SUMMARY

In such context, the Applicant has therefore set the objective of proposing a device for the automatic loading of hangers in an apparatus for ironing shirts or similar items and an apparatus provided with such device which are capable of overcoming the above-indicated drawbacks.

In particular, the Applicant has set the objective of proposing an apparatus with a greater level of automation, such to allow increasing the operating speed of the apparatus, reducing the cycle time, increasing the quality of the ironing, reducing the stress for the operators.

In particular, the Applicant has set as objective that of reducing the manual operations executed by the operator.

The Applicant has found that the above-listed objects and still others can be substantially achieved by equipping the apparatuses for ironing shirts or similar items in series with a loader of hangers capable of automatically positioning a hanger on each manikin before the shirt to be ironed is arranged on the manikin.

In particular, the Applicant has found that the above-listed objects and still others can be substantially achieved by a device and by an apparatus according to one or more of the enclosed claims and/or according to one or more of the following aspects.

According to an independent aspect, the present invention relates to a device for the automatic loading of hangers in an apparatus for ironing shirts or similar items.

Preferably, the apparatus comprises: a conveyor; at least one manikin mounted on the conveyor, wherein the manikin is shaped to accept and support a shirt or similar item to be ironed, wherein the manikin has a seat configured to accept a hanger; a loading station for loading, on the manikin, a shirt to be ironed; at least one ironing station for ironing the shirt supported by the manikin; an unloading station for unloading, from the manikin, the ironed shirt. The conveyor is configured to carry the manikin in succession to each of said loading, ironing and unloading stations.

The device comprises: a storage configured to support a plurality of hangers; an arm comprising a gripping and releasing end. The arm is movable between a first position and a second position. In the first position, the gripping and releasing end is close to the storage to pick up or receive a hanger from said storage. In the second position, the gripping and releasing end is placed above the manikin placed upstream of the loading station, to release the hanger, previously picked up or received, into the seat of said manikin.

According to an independent aspect, the present invention also regards an apparatus for ironing shirts or similar items comprising a device according to the preceding aspect and/or according to one or more of the following aspects.

The Applicant has first of all verified that the device according to the present invention allows automatically loading the hangers and hence reducing the work load of the operator.

The Applicant has verified that the device according to the present invention then allows increasing the operating speed of the apparatus and the quality of the ironed shirts (or similar items).

Further aspects of the present invention are listed hereinbelow.

In one aspect, the apparatus comprises a plurality of manikins mounted on the conveyor, optionally three or four manikins.

In one aspect, the apparatus comprises a plurality of ironing stations, optionally two ironing stations.

In one aspect, the conveyor is a carousel, wherein the loading station, said at least one ironing station and the unloading station are arranged around the carousel.

In one aspect, the device is operating in the unloading station.

In one aspect, the device is associated with the unloading station.

In one aspect, in the second position, the gripping and releasing end is placed above the manikin placed in the unloading station.

In one aspect, the storage comprises a bar, wherein the hangers are hung from the bar.

In one aspect, each hanger comprises a hook or a ring and the hooks or rings of the hangers are constrained to the bar.

In one aspect, when the hanger is in the seat of the manikin, the hook or the ring projects upward from said manikin.

In one aspect, each hanger comprises shoulders for supporting a shirt.

In one aspect, each hanger comprises at least one metal portion, optionally each hanger is made of metal, preferably metal wire.

In one aspect, the bar has a terminal end close to the arm.

In one aspect, the bar is a worm screw configured to bring the hangers towards the terminal end by means of a rotation of said bar around its own main axis, wherein the rotation is operated by a respective motor or actuator.

In one aspect, the hooks or rings of the hangers are situated in a groove of the worm screw.

In one aspect, the storage comprises a separator positioned on the terminal end and configured to accompany a hanger carried on said terminal end towards the gripping and releasing end of the arm.

In one aspect, the separator is a slide having a proximal end arranged at the terminal end of the bar and a distal end opposite the proximal end.

In one aspect, the slide is oriented downward.

In one aspect, the arm comprises an actuator, optionally linear, optionally electric or pneumatic, configured to move the gripping and releasing end between the first and the second position.

In one aspect, the gripping and releasing end of the arm comprises at least one electro-magnet configured for retaining or releasing a hanger.

In one aspect, at least one sensor is positioned at the arm and is configured to detect the presence of a hanger.

In one aspect, said at least one sensor is a proximity sensor, optionally of capacitive or inductive or magnetic or optical type.

In one aspect, said at least one sensor comprises a first sensor configured to detect the passage of a hanger from the storage to the gripping and releasing end of the arm.

In one aspect, the first sensor is directed towards the slide.

In one aspect, said at least one sensor comprises a second sensor configured to detect the presence of a subsequent hanger on the terminal end of the bar.

In one aspect, the second sensor is directed towards the terminal end of the bar.

In one aspect, the gripping and releasing end is shaped as a plate.

In one aspect, said at least one electro-magnet is housed or embedded in the plate.

In one aspect, in the second position, the plate is arranged above the seat of the manikin.

In one aspect, a reader is provided, operating near the arm and configured to read a tag carried by each hanger and comprising an identifier of said hanger.

In one aspect, each hanger comprises a tag.

In one aspect, the tag is mounted below the hook or ring of the hanger.

In one aspect, the tag is selected from the group comprising: a RFID tag (Radio-FRequency Identification), an NFC tag (Near-Field Communication), a BLE beacon (Bluetooth Low Energy), a QR code (Quick Response), a bar code.

In one aspect, the reader is an RFID, NFC, BLE reader, an optical reader or a video camera.

In one aspect, the reader is mounted on the gripping and releasing end.

In one aspect, the reader is mounted on the plate, optionally on a second face of the plate opposite the first face adapted to receive the hanger.

In one aspect, two electro-magnets are provided and the reader is mounted between the two electro-magnets.

In one aspect, an electronic unit is provided.

In one aspect, the reader is operationally connected to the electronic unit.

In one aspect, an auxiliary reader is provided, operationally connected to the electronic unit and configured to read an auxiliary tag carried by each shirt.

In one aspect, the auxiliary tag comprises an auxiliary identifier of the shirt.

In one aspect, the auxiliary tag comprises data relative to the shirt.

In one aspect, the electronic unit is configured to associate the auxiliary identifier of the shirt with the hanger identifier.

The Applicant has verified that the implementation of a tag on the hanger allows automatically managing the shirts unloaded from the apparatus, e.g. in a storage of ironed shirts and/or in order to be able to identify shirts belonging to a same batch, for example belonging to a same client.

In particular, after the auxiliary identifier of the shirt has been associated with the hanger identifier, it is possible, by means of sensors positioned downstream of the apparatus, to precisely trace each shirt by reading the tag of the respective hanger. Such tag is positioned in a very precise point of the hanger and can be easily detected by the sensors—to the contrary of the auxiliary tags attached to the shirts which are not in pre-established positions, as sometimes they are inside the shirt and they may move together with flaps of the same.

In one aspect, the apparatus comprises a pick-up device operating in the unloading station.

In one aspect, the pick-up device comprises a pick-up member movable between a first position and a second position.

In one aspect, in the first position the pick-up member is engaged with a hanger carried by a manikin placed in the unloading station and combined with an ironed shirt.

In one aspect, in the first position the pick-up member is engaged with the hook or ring of the hanger.

In one aspect, the second position of the pick-up member is situated higher than the first position.

In one aspect, the pick-up member can be positioned in a rest position situated between the first position and the second position.

In one aspect, the pick-up member is movable along a closed path between the first and the second position and the rest position.

In one aspect, the pick-up member is movable away from the manikin to carry the ironed shirt hanging from the hanger towards the second position.

In one aspect, the pick-up member is a pin or a rod configured to couple the hanger, preferably to couple the hook or ring of the hanger.

In one aspect, when the pick-up member is in the first position to couple the hanger, the arm is in the respective first position.

In one aspect, when the arm is in its second position, the pick-up member is in the rest position in order to not interfere with the gripping and releasing end.

In one aspect, the pick-up device comprises a vertical column having a guide defining the closed path.

In one aspect, the pick-up device comprises a motor connected to the pick-up member and configured to move said pick-up member along the guide.

In one aspect, the apparatus comprises devices operationally active at the second position of the pick-up member and configured to remove the hanger and the shirt from the pick-up member, and move them away.

Further characteristics and advantages will be clearer from the detailed description of a preferred but non-exclusive embodiment of an apparatus for ironing shirts or similar items in accordance with the present invention.

DESCRIPTION OF THE DRAWINGS

Such description will be set forth hereinbelow with reference to the enclosed drawings, provided as a non-limiting example in which.

DETAILED DESCRIPTION OF EMBODIMENTS OF THE INVENTION

Figure 1:
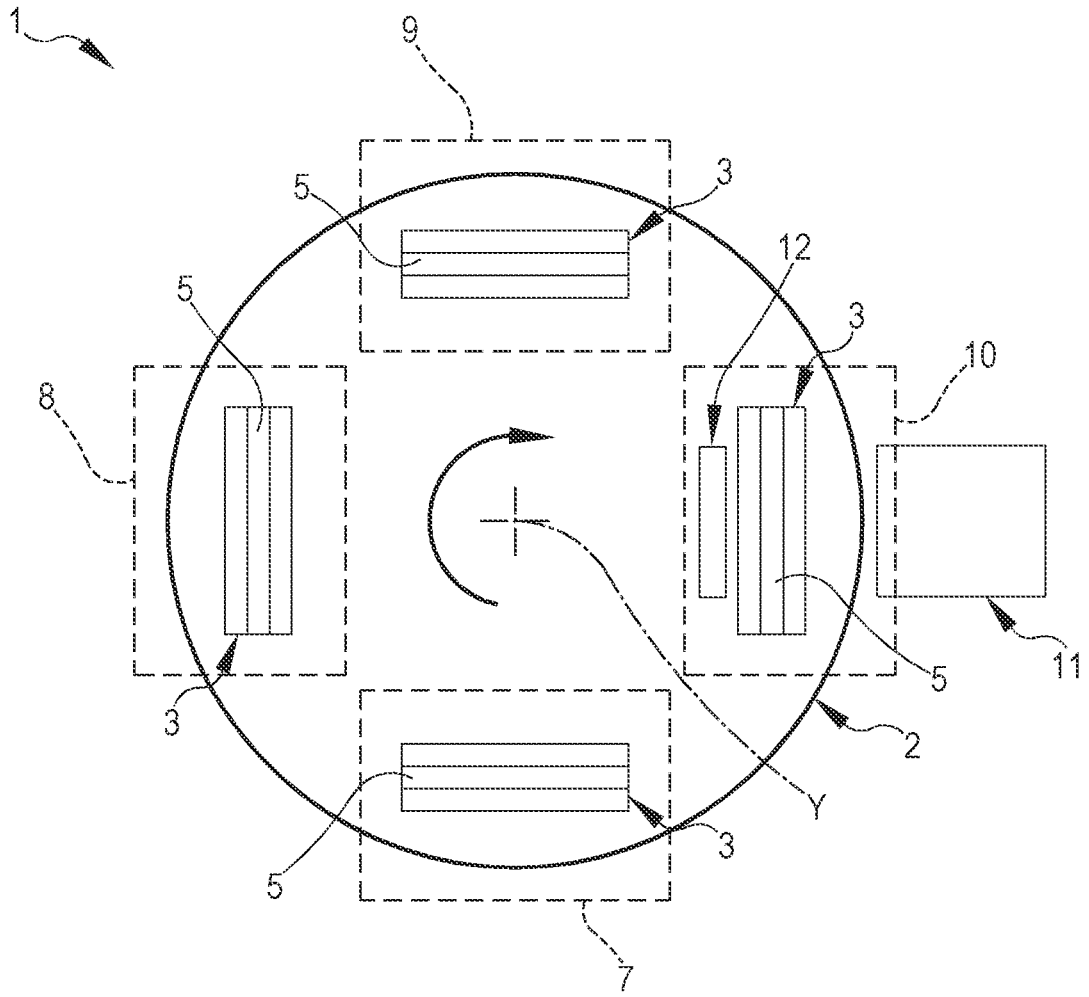
FIG. 1 schematically illustrates a top view of an apparatus for ironing shirts or similar items according to the present invention.

With reference to FIG. 1, reference number 1 overall indicates an apparatus for ironing shirts or similar items (e.g. T-shirts) in series, preferably used in the context of laundries. The apparatus 1 comprises a carousel conveyor 2 which can be rotated by pitches around its own vertical axis "Y" by means of a suitable motor, not illustrated. On the carousel 2, four manikins 3 are mounted which are per se of known shape and configured to support a shirt 4 or similar item (FIGS. 2 and 3) to be ironed.

Each manikin 3, better visible in FIGS. 4 to 8, is similar to a bust and comprises two shoulders and a neck. The manikin 3 also has a seat 5 configured to accept a hanger 6. The seat 5 is an opening made on the shoulders and on the neck. The hanger 6 may be a normal hanger made of metal wire provided with shoulders and with a hook.

The apparatus 1 comprises (FIG. 1) four stations arranged fixed around the carousel conveyor 2. In particular, the apparatus 1 comprises a loading station 7 for loading, on the manikin, a shirt 4 to be ironed; a first and a second ironing station 8, 9 for ironing the shirt 4 supported by the manikin 3; an unloading station 10 for unloading the ironed shirt 4 from the manikin 3. The conveyor 2 is configured to carry each manikin 3 in succession to each of said loading 7, ironing 8, 9 and unloading 10 stations, and keeping each manikin stopped in each station for a predetermined time period. Such stations have been schematically represented since they may also be of known type, and they are not further described herein. The first and the second ironing stations 8, 9 are configured to iron each shirt 4 by means of steam and/or hot air. In such stations, jets of steam and/or hot air are directed on the shirt, internally and/or externally, with the possible aid of tables which are pressed against portions of the shirt itself.

The apparatus 1 also comprises a device 11 for the automatic loading of the hangers 6 on the manikins 3. Such device 11 is positioned in the unloading station 10 and is operating in such unloading station 10 in order to load a hanger 6 on the empty manikin 3, after a preceding hanger 6 with an ironed shirt 4 hung thereon has been unloaded from the manikin 3. For such purpose, in the unloading station 10, a pick-up device 12 is also present and operating.

The pick-up device 12 (FIGS. 2-8) comprises a vertical column 13 having a guide 14 defining the closed path. The vertical column 13 has a lower end which terminates at an upper portion of a manikin 3 (when the latter is in the unloading station 10) and an upper end.

The guide 14 is defined by a groove which has a closed shape with a vertical outgoing section, a vertical return section parallel to the outgoing section, a lower connecting section and an upper connecting section. A pick-up member 15 defined by a pin exits projecting from the guide 14 and is moved along the guide by a motor 15A and possible other elements, not illustrated.

The pick-up member 15 can be moved along the guide 14 between a first position, a second position and a rest position.

In the first position, the pick-up member 15 is situated in the lower connecting section (FIG. 2) such that it can be engaged with the hook of a hanger 6 carried by a manikin 3 placed in the unloading station 10 and combined with an ironed shirt 4.

In the second position, the pick-up member 15 is situated in the upper connecting section (position not illustrated) such that it can be engaged with devices, not illustrated, and transfer the hanger 6 and the shirt 4 to such devices and move them away from the apparatus 1.

In the rest position, the pick-up member 15 is situated in a position placed on the return branch between the first position and the second position (FIGS. 4 to 7).

During operation, the pick-up member 15 is made to move without stopping for the first position and for the second position, while it is stopped in the rest position, as will be detailed hereinbelow.

The device 11 for the automatic loading comprises a bar provided with a groove or worm screw 16 (partially illustrated in FIGS. 2-8), oriented substantially orthogonal to the column 13 and having a terminal end directed towards said column 13. The worm screw 16 is configured to support a plurality of hangers 6 and carry them towards the terminal end by means of a rotation of the worm screw 16 around its own main axis, operated by a respective motor or actuator, not illustrated. The hooks of the hangers 6 are placed in the groove of the worm screw 16. The rotation of the worm screw causes the displacement of the hooks towards the terminal end. The worm screw 16 is therefore part of a storage and of a conveyor for the hangers 6.

The device 11 comprises (FIGS. 2 to 8) a slide 17 which has a proximal end arranged at the terminal end of the worm screw 16 and a distal end opposite the proximal end and directed downward. The worm screw and the slide are fixed, in the sense that they are not moved towards or away from the column 13.

The device 11 also comprises (FIGS. 5 and 6) an arm 18 comprising a gripping and releasing end/head 19 (FIGS. 2 to 8). The arm 18 comprises a linear actuator, e.g. pneumatic or electric, facing the worm screw 16 and provided with movable rods 20. The movable rods 20 carry the gripping and releasing end 19 and the actuator allows moving the rods 20 and the gripping and releasing end 19 between a first position and a second position.

In the first position (FIGS. 2, 3, 4, 7 and 8), the gripping and releasing end 19 is close to the terminal end of the worm screw 16 to pick up or receive a hanger 6 from the storage. In the second position (FIGS. 5 and 6), the gripping and releasing end 19 is placed above the manikin 3 situated in the unloading station 10, to release the hanger 6, previously picked up, into the seat 5 of said manikin 3.

In the illustrated embodiment, the gripping and releasing end 19 is a plate intended to abuttingly receive part of the hanger 6 on its first face directed towards the distal end of the slide 17. The plate has a central portion adapted to receive the hook of the hanger 6 and two lower lobes adapted to receive part of the shoulders of the hanger 6. Each of the lobes carries a respective electro-magnet 21 configured for retaining or releasing a hanger 6. The two electro-magnets 21 protrude from a second face of the plate opposite the first face and are flush with said first face.

The device 11 for the automatic loading comprises a first proximity sensor 22 and a second proximity sensor 23, e.g. of capacitive type. The first proximity sensor 22 is directed towards the slide 17 and the second proximity sensor 23 is directed towards the terminal end of the worm screw 16. The first proximity sensor 22 is configured to detect the passage of a hanger 6 released from the terminal end of the worm screw 16 and which is moved along the slide 17 towards the distal end of the slide 17. The second proximity sensor 23 is configured to detect the presence of a subsequent hanger 6 carried on the terminal end of the worm screw 16.

The slide 17 performs the function of separator positioned on the terminal end and configured to accompany the hanger 6 carried on said terminal end towards the gripping and releasing end 19 of the arm 18.

The device 11 for the automatic loading comprises a reader 24 (better visible in FIG. 8) configured to read a tag 25 carried by each hanger 6. The tag 25 is, in the illustrated non-limiting embodiment, an RFID tag (Radio-FRequency Identification) contained in a small box coupled to the hanger 6 and placed below the respective hook. In other embodiments, the tag may be of different type, e.g. it may be an NFC tag (Near-Field Communication), a BLE beacon (Bluetooth Low Energy), a QR code (Quick Response) or a simple bar code. It follows that the reader 24 may be an RFID, NFC, BLE reader, an optical reader or even a video camera.

Figure 8:
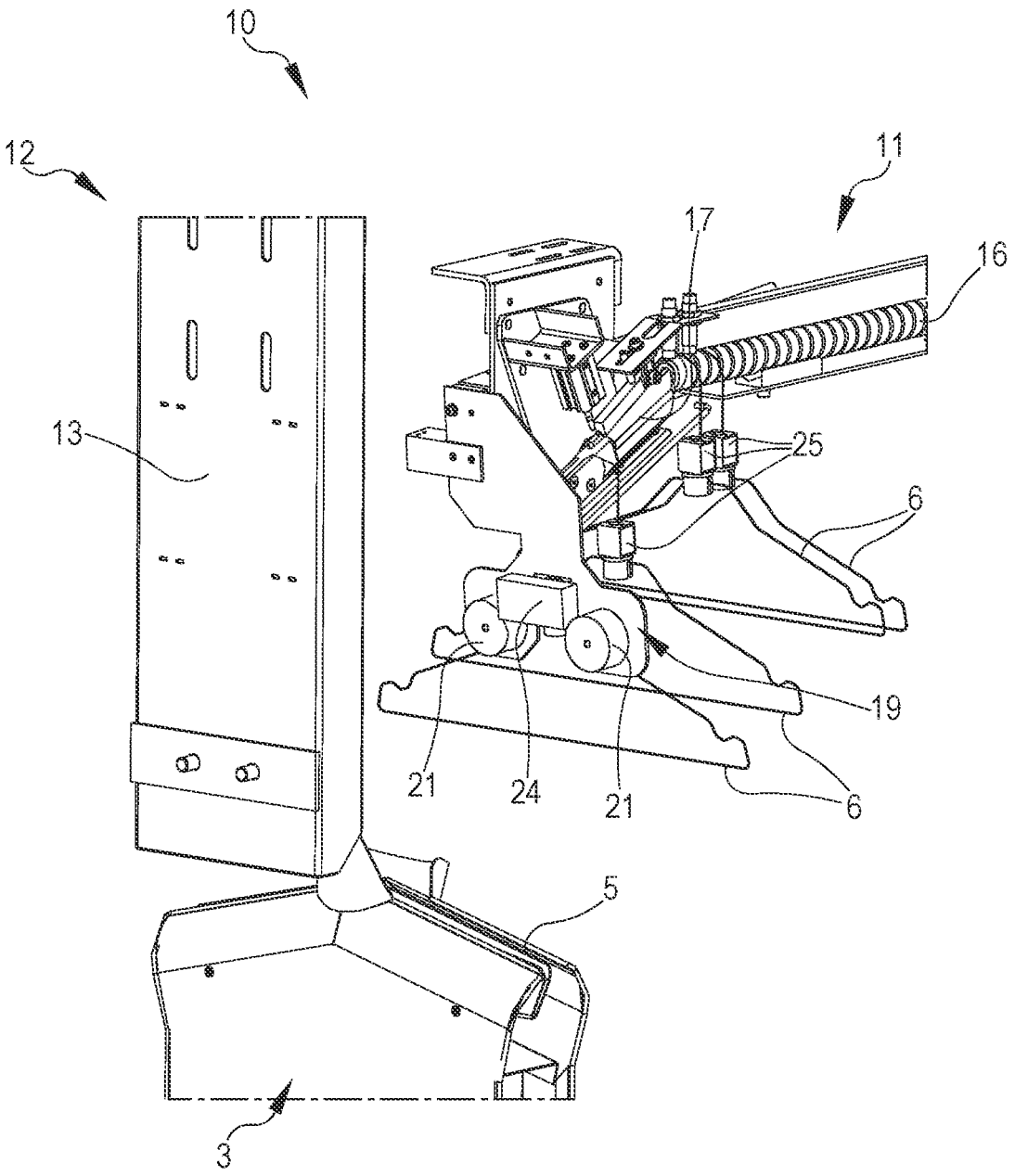

The reader 24 is mounted on the second face of the plate, between the two electro-magnets 21 (FIG. 8).

The tag 25 comprises an identifier which distinguishes each hanger 6 and the reader 24 is capable of reading such identifier.

The apparatus 1 also comprises an auxiliary reader, not illustrated, configured to read an auxiliary tag attached to each shirt 4. The auxiliary tag may be a paper tag with a bar code which contains an auxiliary identifier containing or connected to information relative to the shirt (e.g. the batch, the owner, etc.). The auxiliary reader is for example a portable reader that may be managed by the operator.

The apparatus 1 comprises an electronic unit, not illustrated, configured/programmed to manage the operation of the apparatus 1 itself. The electronic unit is operationally connected to the motor of the carousel conveyor 2, to the motor of the worm screw 14, to the motor 15A of the pick-up member 15, to the electro-magnets 21, to the sensors 22, 23 and to the reader 24, to the auxiliary portable reader, as well as to other elements of the apparatus that are necessary for the operation thereof.

Figure 2:
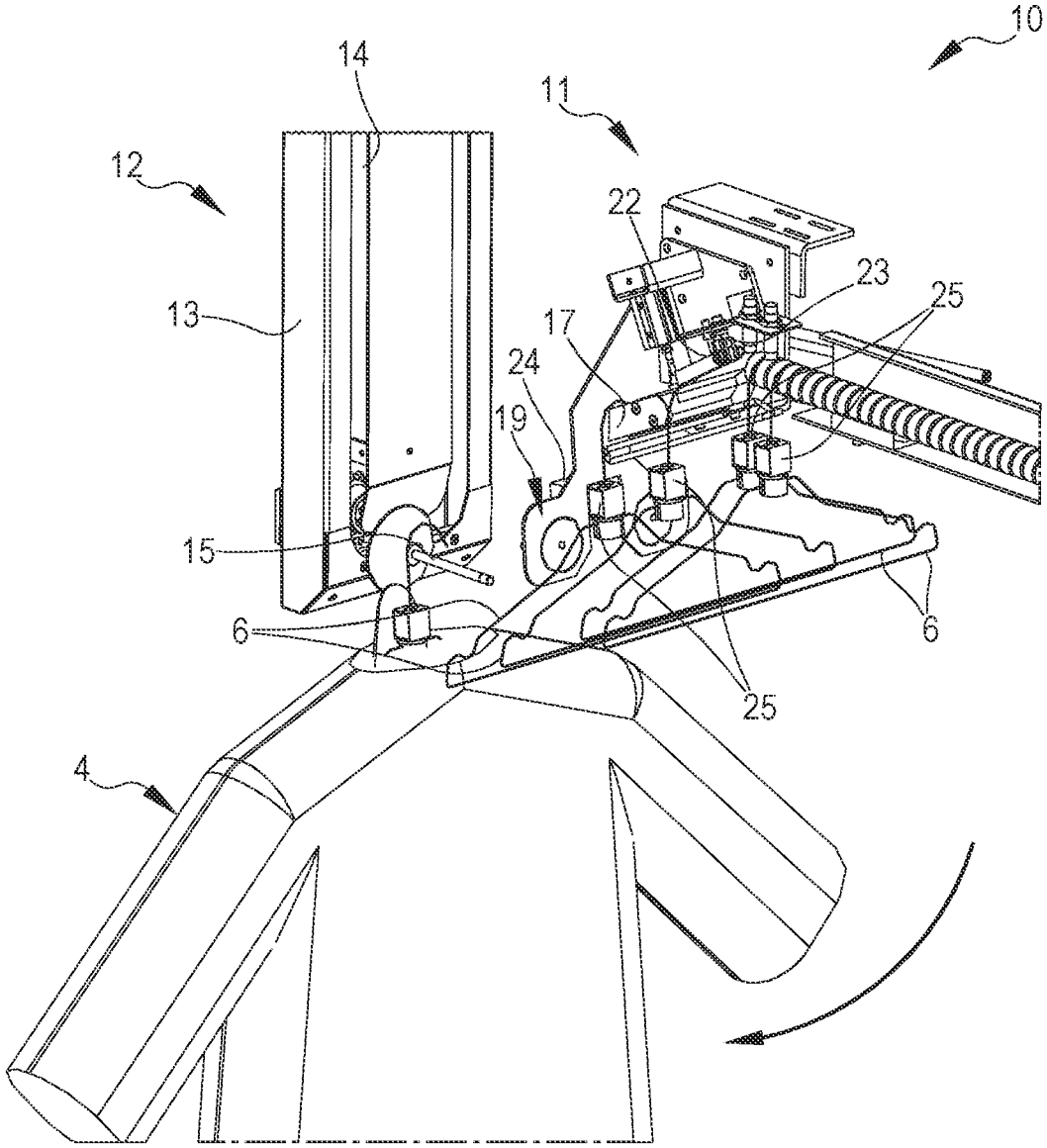
FIGS. 2 to 8 show a portion of an unloading station of the apparatus of FIG. 1 in respective operating steps.
Figure 3:
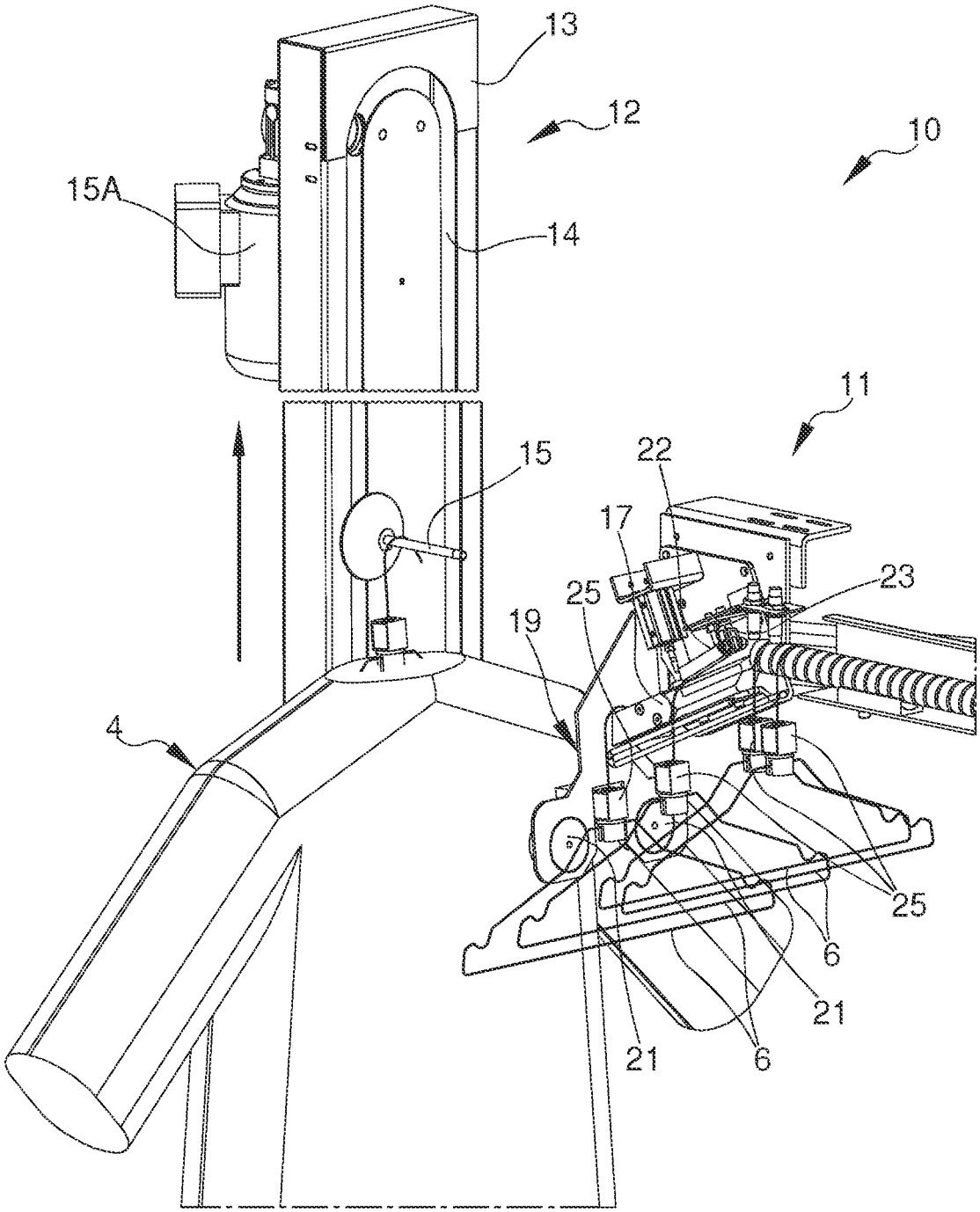
Figure 4:
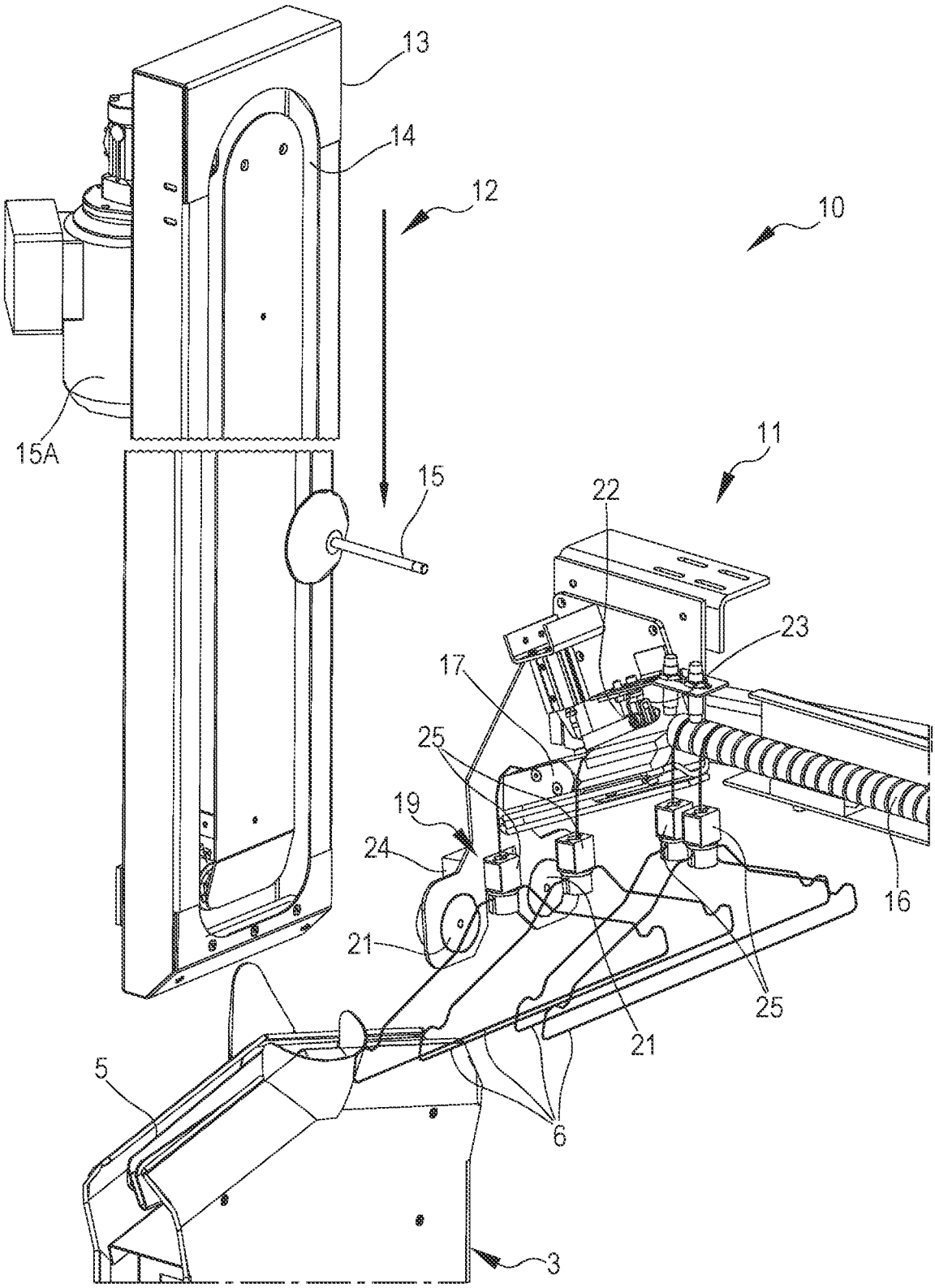
Figure 5:
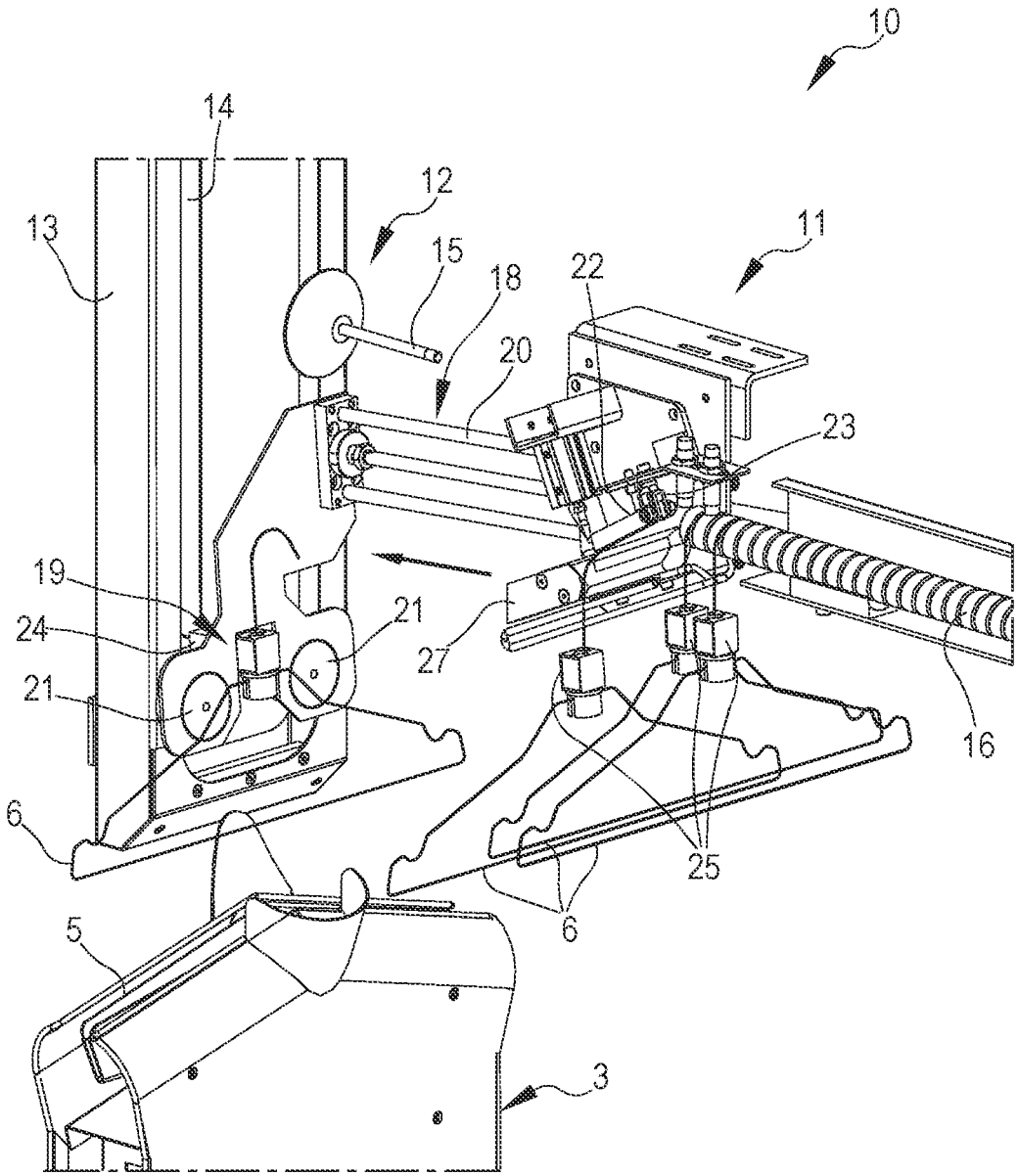

During use, an ironed shirt 4, associated with a hanger 6 and arranged on a manikin 3, arrives at the unloading station 10 (FIG. 2). While the arm 18 is in the respective first position, the pick-up member 15, which was in the rest position, is carried downward along the return branch, it engages the hook of the hanger 6 and lifts it together with the ironed shirt 4 (FIG. 3), carrying the shirt 4 upward to the second position on the upper connecting section, where it releases the hanger 6 and the shirt 4, in order to then redescend and be brought back into into the rest position (FIG. 4). The pick-up member 15 therefore completes a continuous movement along a closed path and is newly stopped in the rest position.

At the second position, for example, the pick-up member 15 hangs the hook of the hanger 6 on a further slide and releases it. The hanger 6 with the shirt 4 slide towards a shirt storage, per se known and not further described herein.

In the unloading station 10, the device 11 for the automatic loading of hangers provides for loading a hanger 6 on the manikin 3, from which the ironed shirt 4 has just been picked up.

For such purpose, while the gripping and releasing end 19 is in its first position and the gripping member 12 is stopped in its rest position, the worm screw 16 is rotated up to bringing the hanger 6 placed on its terminal end to the slide 17. The hanger 6 slides on the slide 17 up to encountering the first face of the plate and the electro-magnets 21 which, once activated, retain it on the gripping and releasing end 19 (FIG. 4). The first sensor 22 detects the actual passage of the hanger 6 which slides towards the plate and the second sensor 23 detects the presence of the subsequent hanger 6 on the terminal end of the worm screw 16. The electronic unit activates the electro-magnets 21 when it receives the signal from the first sensor 22 and stops the rotation of the worm screw 16 when it receives the signal from the second sensor 23. In addition, the reader 24 reads from the RFID tag 25 the identifier (e.g. a numeric code) of the hanger 6 attached to the plate and transmits it to the electronic unit.

Figure 6:
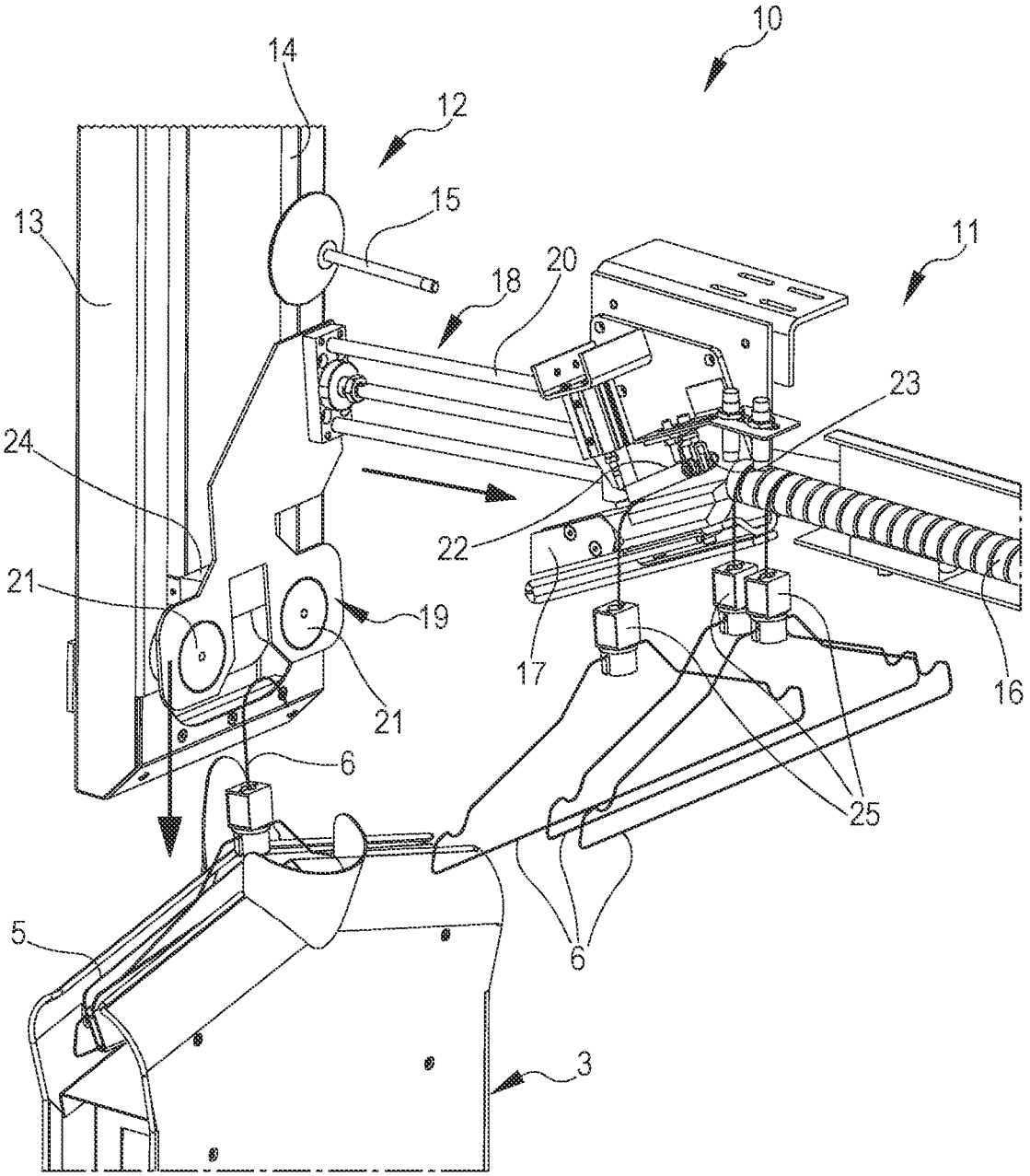
Figure 7:
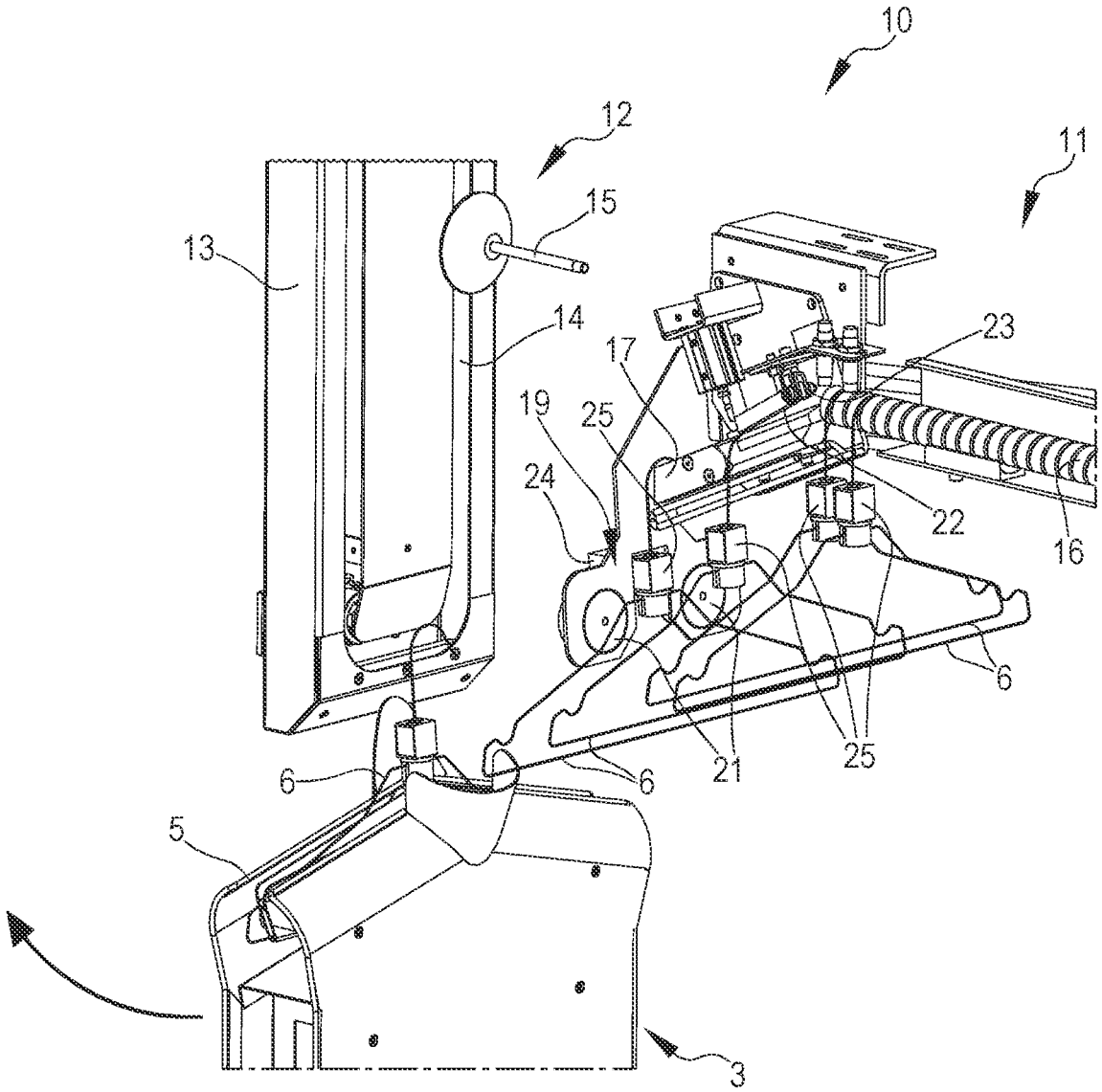

The electronic unit drives the actuator of the arm 18 which carries the gripping and releasing end/head 19 into its second position (FIG. 5) in which the plate is arrange above the seat 5 of the manikin 3 and then it deactivates the electro-magnets 21 so that the hanger 6 falls into the seat 5 (FIG. 6). The hanger 6 is housed in the seat 5 with its own hook that protrudes upward.

At this point, the arm 18 is brought back into its first position (FIG. 7) and the carousel conveyor 2 is rotated by a pitch (90°) so as to carry the manikin 3 provided with the hanger 6 into the loading station 7. In the loading station 7, the operator takes a shirt 4, for example from a pack or from a container, with the auxiliary reader he/she reads the auxiliary tag attached to the shirt 4, he/she positions the shirt on the manikin 3 and completes the possible further operations necessary for the subsequent ironing.

The electronic unit couples the identifier of the hanger 6 with that of the shirt 4 and saves them, for example, in a database in which also further information is contained relative to the shirt 4, such as for example the name of the client, the batch to which the shirt 4 belongs, etc. In this manner, in the further stations of the ironing apparatus or even downstream of the ironing apparatus (e.g. in a mechanized shirt storage), the shirt can be traced by only reading the tag 25 on the hanger 6.

The carousel conveyor 2 is rotated by a pitch (90°) so as to carry the manikin 3 provided with the hanger 6 and with the shirt 4 to be ironed into the first ironing station 8, in which a first ironing step is executed, and then into the second ironing station 9 in which a second ironing step is executed.

At the end of the second ironing step, the carousel conveyor 2 is rotated by a pitch (90°) to carry the manikin 3 provided with the hanger 6 and with the shirt 4 into the unloading station 10 where the cycle starts over again.

The above-described apparatus may also operate without the electronic unit coupling the identifier of the hanger 6 with that of the shirt 4 and/or with hangers 6 without tag 25.

In addition, in a simpler alternative embodiment, the device 11 is not provided with the reader 24 and the hangers 6 lack the tags 24. In addition, since the reader 24 is not present on the plate, the plate has smaller dimensions and there is only one electro-magnet 21 centrally positioned on said plate.

LIST OF ELEMENTS

1 apparatus for ironing shirts or similar items in series
2 conveyor
3 manikins
4 shirt
5 seat
6 hanger
7 loading station
8 first ironing station
9 second ironing station
10 unloading station
11 device for the automatic loading of the hangers
12 pick-up device
13 vertical column
14 guide
15 pick-up member
15A motor
16 worm screw
17 slide
18 arm
19 gripping and releasing end
20 rods
21 electro-magnet
22 first proximity sensor
23 second proximity sensor
24 reader
25 tag

The invention claimed is:

1. Device for the automatic loading of hangers into an apparatus for ironing shirts or similar items, wherein the apparatus comprises:

a conveyor (2);

at least one manikin (3) mounted on the conveyor (2), wherein the manikin (3) is shaped to accept and support a shirt (4) or similar item to be ironed, wherein the manikin (3) has a seat (5) configured to accept a hanger (6);

a loading station (7) for loading, on the manikin (3), a shirt (4) to be ironed;

at least one ironing station (8, 9) for ironing the shirt (4) supported by the manikin (3);

an unloading station (10) for unloading the ironed shirt (4) from the manikin (3);

wherein the conveyor (2) is configured to carry the manikin (3) in succession to each of said loading (7), ironing (8, 9) and unloading (10) stations;

the device (11) comprising:

a storage configured to support a plurality of hangers (6);

an arm (18) comprising a gripping and releasing end (19), wherein the arm (19) is movable between a first position and a second position; wherein, in the first position, the gripping and releasing end (19) is close to the storage to pick up or receive a hanger (6) from said storage; wherein, in the second position, the gripping and releasing end (19) is placed above the manikin (3) upstream of the loading station (7), to release the hanger (6), previously picked up or received, into the seat (5) of the manikin (3).

2. The device according to claim 1, wherein the device (11) is operating in the unloading station (10).

3. The device according to claim 1, wherein the storage comprises: a bar (16) having a terminal end close to the arm (18), wherein the hangers (6) are hung from the bar (16).

4. The device according to claim 3, wherein the bar (16) is a worm screw configured to bring the hangers (6) towards the terminal end by means of a rotation of said bar (16) around its own main axis.

5. The device according to claim 4, wherein the storage comprises: a separator positioned on the terminal end and configured to accompany a hanger (6) carried on said terminal end towards the gripping and releasing end (19) of the arm (18).

6. The device according to claim 5, wherein the separator is a slide (17) having a proximal end placed close to the terminal end of the bar (16) and a distal end opposite the proximal end.

7. The device according to claim 3, wherein the storage comprises: a separator positioned on the terminal end and configured to accompany a hanger (6) carried on said terminal end towards the gripping and releasing end (19) of the arm (18).

8. The device according to claim 7, wherein the separator is a slide (17) having a proximal end placed close to the terminal end of the bar (16) and a distal end opposite the proximal end.

9. The device according to claim 1, wherein each of the hangers (6) comprises at least one metal portion and wherein the gripping and releasing end (19) of the arm (18) comprises at least one electro-magnet (21) configured to hold or release a hanger (6).

10. The device according to claim 1, comprising at least one sensor positioned at the arm (18) and configured to detect the presence of a hanger (6).

11. The device according to claim 10, wherein said at least one sensor comprises a first sensor (22) configured to detect the passage of a hanger (6) from the storage to the gripping and releasing end (19) of the arm (18) and a second sensor (23) configured to detect the presence of a subsequent hanger (6) on the terminal end of the arm (18).

12. The device according to claim 1, also comprising a reader (24) operating near the arm (18) and configured to read a tag (25) carried by each hanger (6) and comprising an identifier of said hanger (6).

13. The device according to claim 12, wherein the reader (24) is mounted on the gripping and releasing end (19).

14. The device according to claim 13, wherein the tag (25) is selected from the group comprising: an RFID tag, an NFC tag, a BLE beacon, a QR code, a bar code.

15. The device according to claim 14, wherein the reader (24) is an RFID, NFC, BLE reader, an optical reader or a camera.

16. The device according to claim 12, wherein the tag (25) is selected from the group comprising: an RFID tag, an NFC tag, a BLE beacon, a QR code, a bar code.

17. The device according to claim 16, wherein the reader (24) is an RFID, NFC, BLE reader, an optical reader or a camera.

18. Apparatus for ironing shirts or similar items comprising a device according to claim 1.

19. Apparatus according to claim 18, comprising:

an electronic unit, wherein the reader (24) is operationally connected to the electronic unit;

an auxiliary reader operationally connected to the electronic unit and configured to read an auxiliary tag carried by each shirt (4), wherein the auxiliary tag comprises an auxiliary identifier (4); wherein the electronic unit is configured to associate the auxiliary identifier of the shirt (4) with the hanger identifier (6);

a pick-up device (12) operating in the unloading station (10), wherein the pick-up device (12) comprises a pick-up element (15) movable between a first position and a second position, wherein in the first position the pick-up member (15) engages with a hanger (6) carried by a manikin (3) placed in the unloading station (10) and combined with an ironed shirt (4), wherein the pick-up member (15) is movable away from the manikin (3) to carry the ironed shirt (4) hanging from the hanger (6) towards the second position.

* * * * *